US007185396B2

(12) United States Patent
Im et al.

(10) Patent No.: US 7,185,396 B2
(45) Date of Patent: Mar. 6, 2007

(54) BRUSH OF CLEANER

(75) Inventors: Hyoung-Bin Im, Gyeonggi-Do (KR); Sung-Il Park, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 608 days.

(21) Appl. No.: 10/657,167

(22) Filed: Sep. 9, 2003

(65) Prior Publication Data

US 2004/0111827 A1 Jun. 17, 2004

(30) Foreign Application Priority Data

Dec. 13, 2002 (KR) ..... 10-2002-0079823

(51) Int. Cl.
*A47L 5/00* (2006.01)

(52) U.S. Cl. ..... 15/366; 15/383; 15/23; 15/52.1; 15/DIG. 5

(58) Field of Classification Search ..... None
See application file for complete search history.

(56) References Cited

U.S. PATENT DOCUMENTS 1,884,013 A * 10/1932 Losey ..... 15/383
6,286,169 B1 * 9/2001 D'Costa et al. ..... 15/52.1

FOREIGN PATENT DOCUMENTS

| | | |
|---|---|---|
| FR | 1377905 | 9/1964 |
| GB | 1321081 | 6/1973 |
| JP | 5-42074 | 2/1993 |

OTHER PUBLICATIONS

English language Abstract of JP 5-42074.

* cited by examiner

*Primary Examiner*—David Redding
(74) *Attorney, Agent, or Firm*—Greenblum & Bernstein, P.L.C.

(57) ABSTRACT

A brush of a cleaner comprising: a rotation shaft rotatably supported at a lower surface of a body; a brush hub fixed to the rotation shaft; and brush hair mounted at an outer circumference surface of the brush hub for sweeping dust and contamination of a floor, wherein the brush hair is composed of a first row arranged toward a shaft direction of the brush hub and divided into a first hair portion which is not contacted with a floor and a second hair portion which is contacted with the floor, and a second row sequentially arranged with the first row and divided into a first hair portion which is contacted with the floor by facing to the first hair portion of the first row and a second hair portion which is not contacted with the floor by facing to the second hair portion of the first row.

14 Claims, 4 Drawing Sheets

BRUSH OF CLEANER

BACKGROUND OF THE INVENTION

1. Field of the Invention

The present invention relates to a brush of a cleaner, and more particularly, to a brush of a cleaner capable of reducing a load which drives the brush and increasing cleaning efficiency by reducing a contact area of the brush with a floor.

2. Description of the Related Art

Generally, a robot cleaner moves by itself without a user's control thus to clean, moves to a charging device by itself if a power of a charger is consumed thus to charge, and moves to an original cleaning area if a charging of the charger is completed thus to continuously clean.

FIG. 1 is a sectional view showing a general robot cleaner.

The general robot cleaner comprises: a body 2; a suction motor 4 mounted in the body 2 for generating a suction force; a filter container 8 mounted at a rear side of the suction motor 4 and contained a filter 6 for collecting dust and contamination material sucked by the suction motor 4; a suction opening 12 connected to the filter container 8 by a suction pipe 10 and formed at a lower side of the body 2, for sucking dust and contamination material of a floor 44; a brush 14 rotatably mounted at one side of the suction opening 12 for sweeping the dust and contamination material of the floor; and a control unit 16 for making the cleaner automatically move thus to clean.

An ultrasonic wave transmitting unit 18 for transmitting ultrasonic wave when the body 2 moves, and an ultrasonic wave receiving unit 20 for receiving ultrasonic wave transmitted from the ultrasonic wave transmitting unit 18 are mounted at a front side of the body 2 in order to aware a position of an obstacle.

A charge terminal 22 mounted at a rear side of the body 2 is connected to a connection terminal 26 installed at an indoor wall surface 24 thus to charge a battery 28. Also, a light emitting unit 40 for inducing the charge terminal 22 to the connection terminal 26 is installed at the rear side of the body 2, and a light receiving unit 42 for receiving an optical signal emitted from the light emitting unit 40 is installed at the indoor wall surface 24 where the connection terminal 26 is arranged.

A driving wheel 30 driven by a signal of the control unit 16, and a supplementary wheel 32 for supporting the rear side of the body 2 are mounted at a lower side of the body 2.

Operations of the conventional cleaner will be explained as follows.

First, if the user presses an operational button, a power source of the battery 28 is transmitted to the suction motor 4 thus to drive the suction motor 4 and thereby to generate a suction force. According to this, dust and contamination material of the floor are sucked into the suction opening 12, pass through the suction pipe 10, and are collected in the filter 6. At this time, the dust and contamination material of the floor are swept into the suction opening 12 in accordance with that the brush 14 is rotated. Also, the driving wheel 30 is driven by a signal from the control unit 16, so that the body 2 is moved to automatically perform a cleaning.

The body 2 is moved with avoiding obstacles by operations of the ultrasonic wave transmitting unit 18 and the ultrasonic wave receiving unit 20 arranged at the front side of the body 2.

While said cleaning operation is performed, if a voltage level of the battery 28 is lowered under a predetermined level, the control unit 16 stops the cleaning operation of the cleaner, moves the body 2 to the indoor wall surface where the connection terminal 26 is installed, connects the charge terminal 22 mounted at the rear side of the body 2 to the connection terminal 26 thus to charge the charge battery 28.

If the charge of the battery 28 is completed, the control unit 16 separates the charge terminal 22 from the connection terminal 26 and performs the cleaning again.

FIG. 2 is a perspective view showing a brush of a cleaner in accordance with the conventional art, FIG. 3 is a sectional view showing the brush of the cleaner in accordance with the conventional art, and FIG. 4 is a side view showing the brush of the cleaner in accordance with the conventional art.

The conventional brush of a cleaner comprises: a rotational axis 50 rotatably mounted at one side of the suction opening 12 and rotated by a driving means; a brush hub 52 fixed to an outer circumference surface of the rotational axis 50 thus to be rotated together if the rotational axis 50 is rotated; and brush hair 54 mounted at an outer circumference surface of the brush hub 52 with the same interval and rotated with contacting to a floor, for sweeping dust or contamination material of the floor.

Herein, the brush hair 54 is mounted at the outer circumference surface of the brush hub 52 toward a circumference direction with the same interval and the same length.

However, in the conventional brush of a cleaner, since the length of the brush hair 54 is equal, all brush hair 54 locate at one row mounted toward an axial direction of the brush are contacted to the floor. According to this, a load of the cleaner becomes great and a cleaning efficiency is lowered.

SUMMARY OF THE INVENTION

Therefore, an object of the present invention is to provide a brush of a cleaner which can reduce a brush rotation load and enhance a cleaning efficiency by dividing bush hair into a contact portion with a floor and a non-contact portion and thus by reducing a contact area with the floor.

To achieve these and other advantages and in accordance with the purpose of the present invention, as embodied and broadly described herein, there is provided a brush of a cleaner comprising: a rotation shaft rotatably supported at a lower surface of a body; a brush hub fixed to the rotation shaft; and brush hair mounted at an outer circumference surface of the brush hub for sweeping dust and contamination of a floor, wherein the brush hair is composed of a first row divided into a first hair portion which is not contacted with a floor and a second hair portion which is contacted with the floor, and a second row sequentially arranged with the first row and divided into a first hair portion which is contacted with the floor by facing to the first hair portion of the first row and a second hair portion which is not contacted with the floor by facing to the second hair portion of the first row.

The first row and the second row of the brush hair are mounted toward a shaft direction of the brush hub and sequentially arranged toward a circumference direction of the brush hub.

The second hair portion of the first row of the brush hair is located at a center of the brush hub thus to be contacted with the floor, and the first hair portion of the first row is located at both sides of the brush hub and formed to be lower than the second hair portion.

A length of the second hair portion of the first row of the brush hair is longer than that of one first hair portion and shorter than that obtained by adding two first hair portions.

The first hair portion of the second row of the brush hair is located at both sides of the brush hub thus to be contacted with the floor, and the second hair portion of the second row is located at the center of the brush hub and formed to be lower than the first hair portion of the second row.

A length of the second hair portion of the second row of the brush hair is longer than that of one first hair portion and shorter than that obtained by adding two first hair portions.

The brush hair is mounted toward a shaft direction of the brush hub and has a blade form arranged toward a circumference direction of the brush hair with the same interval.

The brush hair has a minute hair form arranged as one row toward a shaft direction of the brush hub.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A brush of a cleaner according to the present invention can have several preferred embodiments, but the most preferred embodiment will be explained hereinafter.

Figure 5:
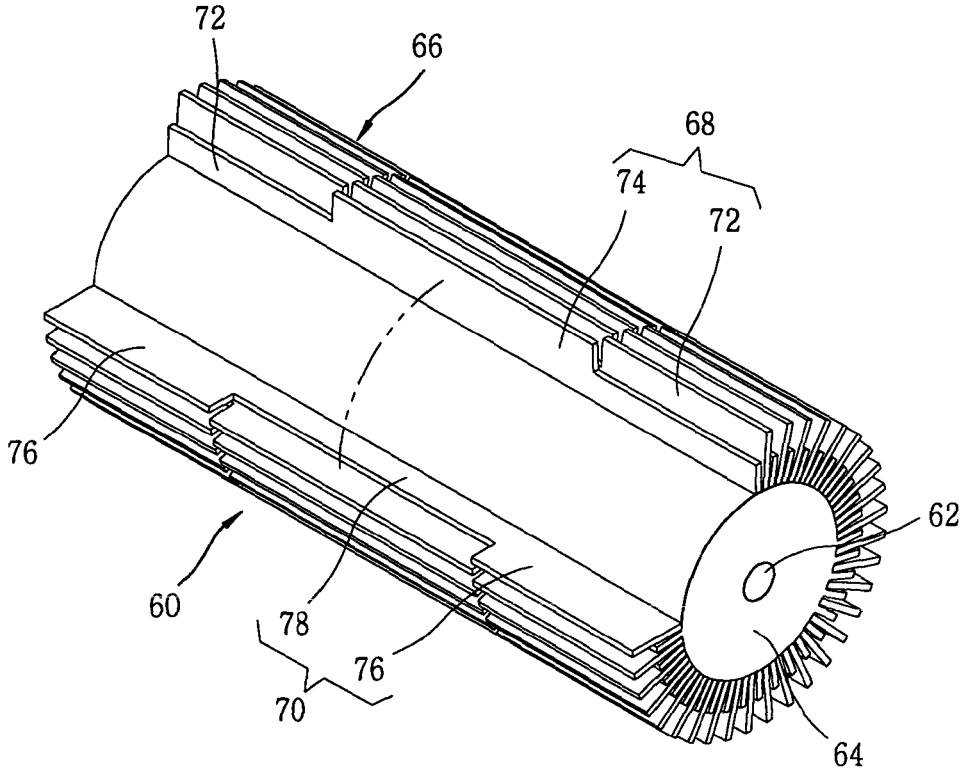
FIG. 5 is a perspective view showing a brush of a cleaner according to the present invention.

FIG. 5 is a perspective view of a brush of a cleaner according to the present invention.

Figure 1:
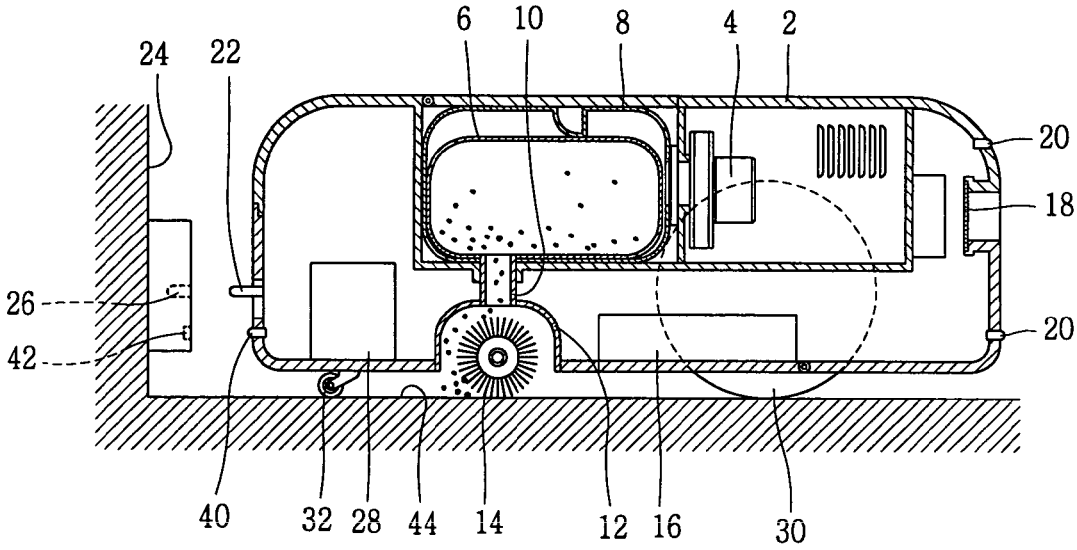
FIG. 1 CONVENTIONAL ART
FIG. 1 is a sectional view of a general robot cleaner.
Figure 2:
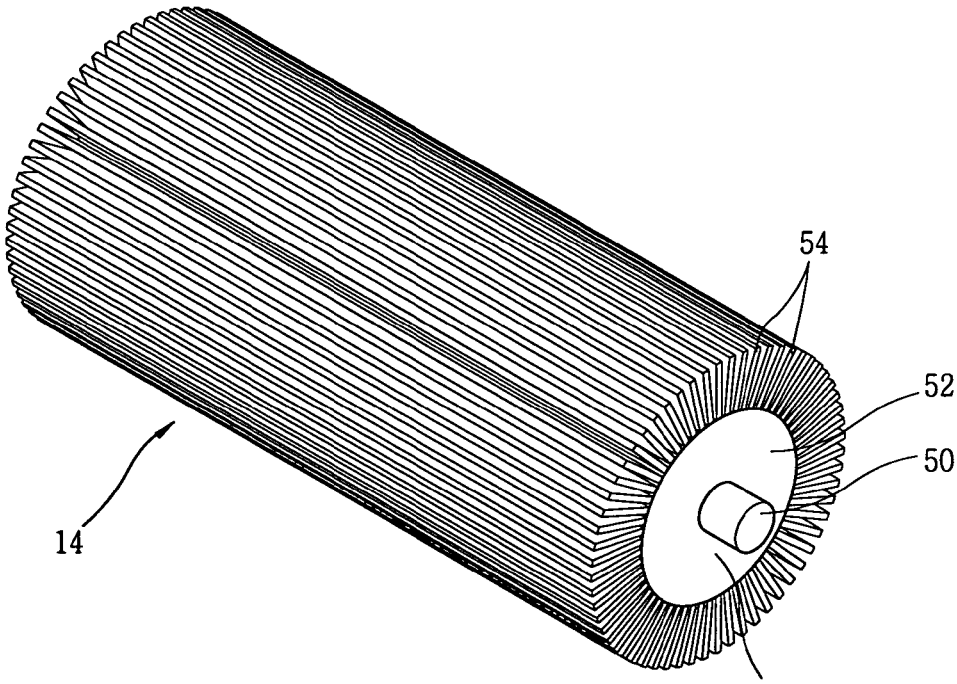
FIG. 2 CONVENTIONAL ART
FIG. 2 is a perspective view showing a brush of a cleaner in accordance with the conventional art.
Figure 3:
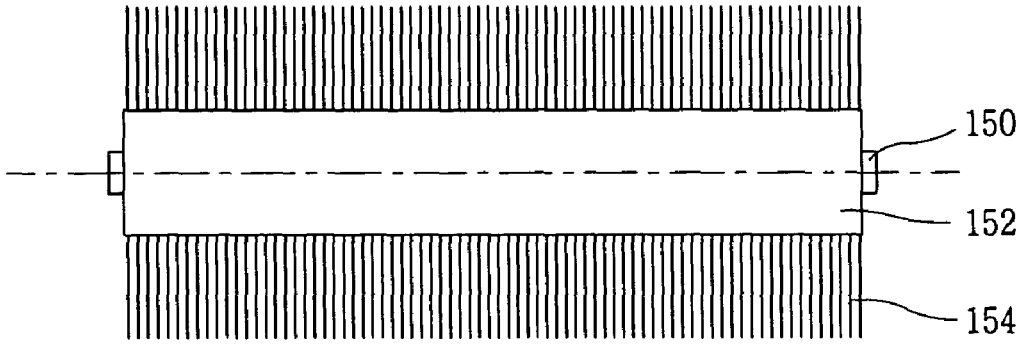
FIG. 3 CONVENTIONAL ART
FIG. 3 is a sectional view showing the brush of the cleaner in accordance with the conventional art.
Figure 4:
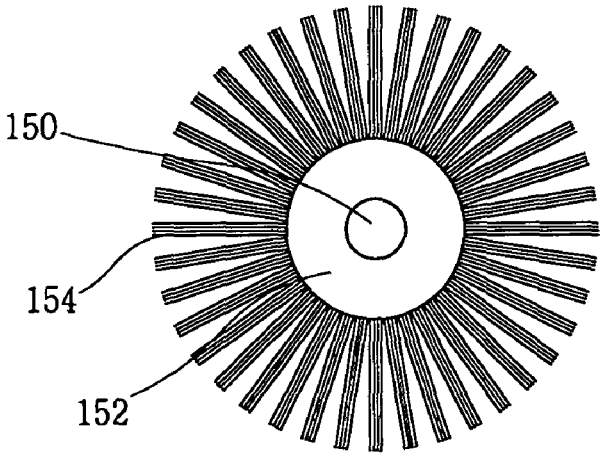
FIG. 4 CONVENTIONAL ART
FIG. 4 is a side view showing the brush of the cleaner in accordance with the conventional art.

Referring to FIG. 1, the robot cleaner according to the present invention comprises: a body 2; a suction motor 4 mounted in the body 2 for generating a suction force; a filter container 8 mounted at a rear side of the suction motor 4 and contained a filter 6 for collecting dust and contamination material sucked by the suction motor 4; a suction opening 12 connected to the filter container 8 by a suction pipe 10 and formed at a lower side of the body 2, for sucking dust and contamination material of a floor 44; and a brush 60 rotatably mounted at one side of the suction opening 12 for sweeping the dust and contamination material of the floor.

A driving wheel 30 driven by a driving means, and a supplementary wheel 32 for supporting the rear side of the body 2 are mounted at the body 2. Also, a battery 28 for applying a power source to the suction motor 4 is mounted in the body 2.

The brush 60 comprises: a rotation shaft 62 rotatably mounted in the suction opening 12 and connected with the driving wheel 30 thus for receiving a driving force or being rotated by an additional driving means; a brush hub 64 of a cylindrical shape in which the rotation shaft 62 is inserted and fixed; and brush hair 66 mounted at an outer circumference surface of the brush hub 64 and contacted with the floor thus for sweeping dust or contamination material of the floor if the brush hub 64 is rotated.

Herein, the brush hair 66 is composed of a first row 68 arranged as a straight line form toward a shaft direction of the brush hub 64, and a second row 70 sequentially arranged with the first row 68 toward a circumference direction of the brush hub 64.

Figure 6:
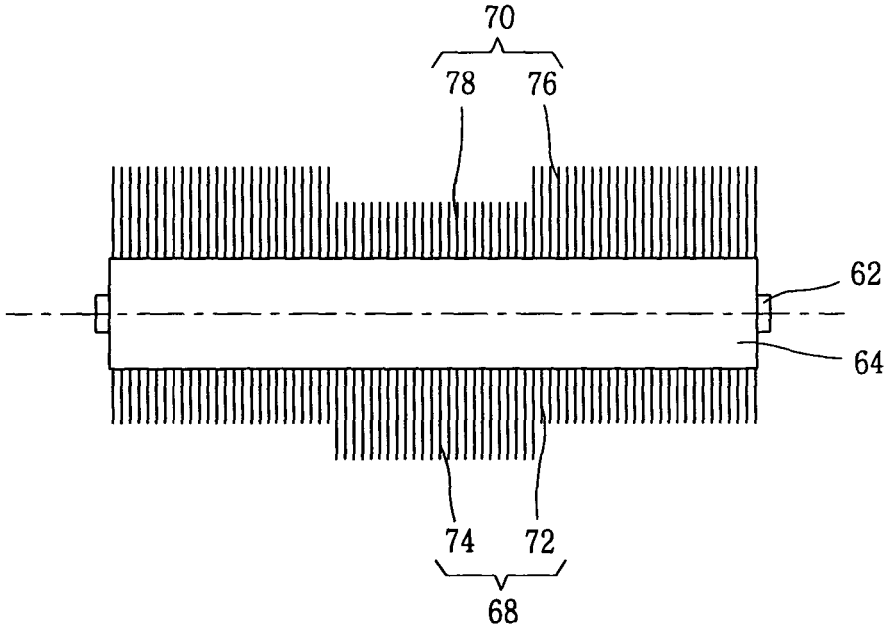
FIG. 6 is a sectional view showing a brush of a cleaner according to a second embodiment of the present invention.
Figure 7:
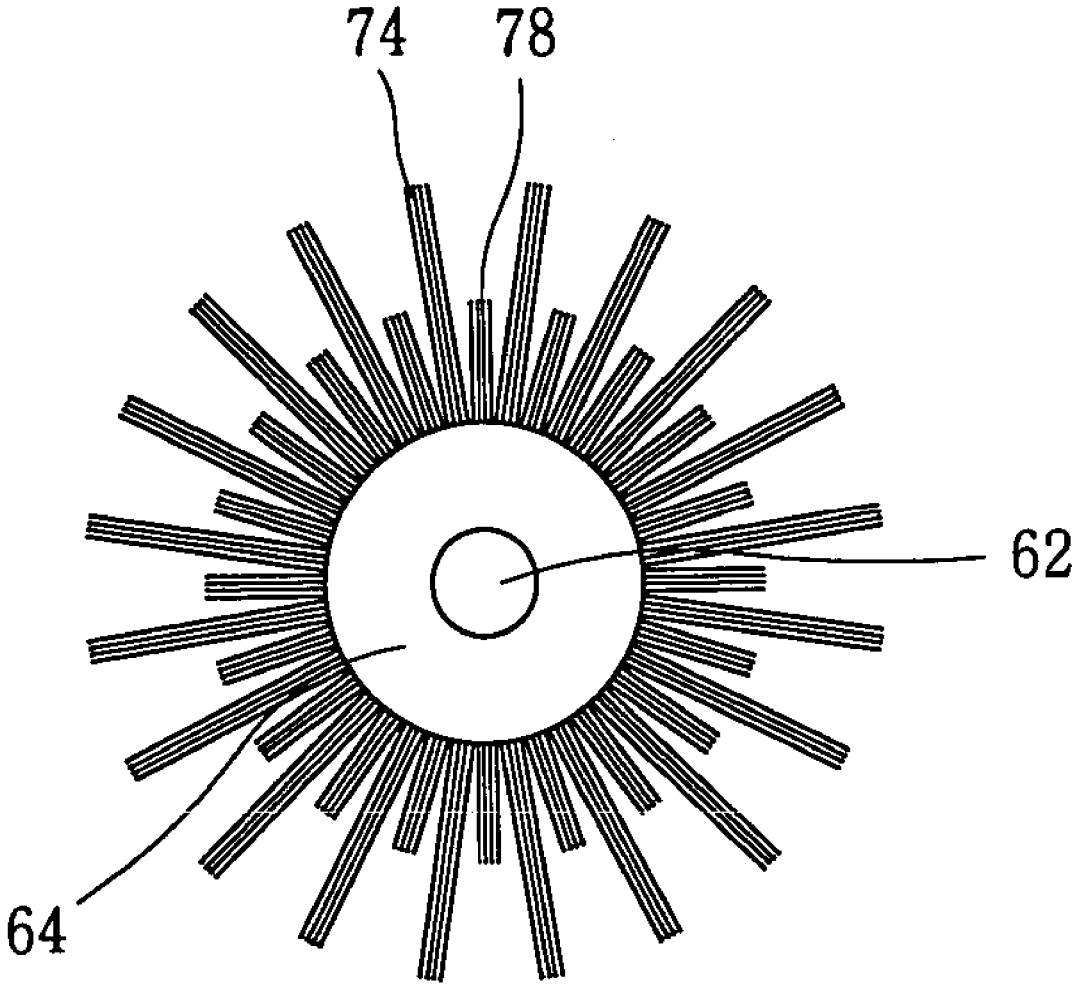
FIG. 7 is a side view showing the brush of the cleaner according to a second embodiment of the present invention.

The first row 68 and the second row 70 can be integrally formed as a blade or the first row 68 and the second row 70, as shown in FIGS. 6 and 7, can be arranged as a minute hair form of one row.

The first row 68 of the brush hair 66 is composed of a first hair portion 72 formed to be low on a surface of the brush hub 64 thus not to be contacted with the floor and located at both sides of the brush hub 64, and a second hair portion 74 located at a center of the brush hub 64 and formed to be higher than the first hair portion 72 thus to be contacted with the floor.

A length of the second hair portion 74 is longer than that of one first hair portion 72 on the basis of a longitudinal direction of the brush hub 64, and is shorter than that obtained by adding two first hair portions 72.

The second row 70 of the brush hair 66 is sequentially located with facing to the first row 68, and composed of a first hair portion 76 formed to be high on the surface of the brush hub 64 thus to be contacted with the floor and located at both sides of the brush hub 64; and a second hair portion 78 located at the center of the brush hub 64 and formed to be lower than the first hair portion 76 thus not to be contacted with the floor.

Herein, the first hair portion 72 of the first row 68 has the same length as the second hair portion 78 of the second row 70, and the second hair portion 74 of the first row 68 has the same length as the first hair portion 76 of the second row Also, the first hair portion 72 of the first row 68 has the same height as the second hair portion 78 of the second row 70, and the second hair portion 74 of the first row 68 has the same height as the first hair portion 76 of the second row 70.

Like this, in the first row 68 of the brush hair 66, the second hair portion 74 mounted at the center of the brush hub 64 is high thus to be contacted with the floor, and in the second row 70, the first hair portion 76 located at both sides of the brush hub 64 is high thus to be contacted with the floor. Accordingly, if the brush 66 is rotated, the second hair portion 74 of the first row 68 of the brush hair 66 sweeps dust and contamination material of the floor which are at the center of the brush hub 64, and then the first hair portion 76 of the second row 70 sweeps dust and contamination material which are at both sides of the brush hub 64.

Operations of the brush of a cleaner according to the present invention will be explained.

If the user presses an operational button, a power source of the battery is transmitted to the suction motor 4 and the suction motor 4 is driven thus to generate a suction force. According to this, dust and contamination material of the floor are sucked into the suction opening 12 and collected in the filter 6 through the suction pipe 10. At this time, the brush 60 mounted at the suction opening 12 is rotated thus to sweep the dust and contamination material of the floor into the suction opening 12.

That is, in the brush 60, the rotation shaft 62 is rotated by the driving means and the brush hub 64 fixed to the rotation shaft 62 is rotated with the rotation shaft 62. According to this, the brush hair 66 contacted with the floor sweeps the floor, so that the dust and contamination material of the floor are sucked into the suction opening 12.

The brush hair 66 is operated as follows. First, if the second hair portion 74 of the first row 68 of the brush hair 66 sweeps the floor, a floor corresponding to the center part of the brush hub 64 is swept. Then, the first hair portion 76 of the second row 70 sweeps the floor, a floor corresponding to both sides of the brush hub 64 is swept thus to remove the dust and contamination material of the floor entirely.

Therefore, in the brush of a cleaner of the present invention, the first row 68 of the brush hair 66 has the center part formed to be higher than both sides, and the second row 70 has the center part formed to be lower than both sides. According to this, the center part of the first row 68 and both sides of the second row 70 are sequentially contacted with the floor thus to reduce a frictional loss between the brush hair 66 and the floor, thereby reducing a load and increasing a cleaning efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A brush of a cleaner comprising:

a rotation shaft rotatably supported at a lower surface of a body;

a brush hub fixed to the rotation shaft; and brush hair mounted at an outer circumference surface of the brush hub to sweep dust and contamination of a floor, wherein the brush hair comprises:

a first row divided into a first hair portion which is not contacted with a floor and a second hair portion which is contacted with the floor;

a second row sequentially arranged with the first row, and divided into a first hair portion which is contacted with the floor by facing to the first hair portion of the first row and a second hair portion which is not contacted with the floor by facing to the second hair portion of the first row; and the second hair portion of the first row of the brush hair is located at a center of the brush hub thus to be contacted with the floor, and the first hair portion of the first row is located at both sides of the brush hub and formed to be lower than the second hair portion.

2. The brush of a cleaner of claim 1, wherein the first row and the second row of the brush hair are mounted toward a shaft direction of the brush hub and sequentially arranged toward a circumference direction of the brush hub.

3. The brush of a cleaner of claim 1, wherein a length of the second hair portion of the first row of the brush hair is longer than that of one first hair portion and shorter than that obtained by adding two first hair portions.

4. A brush of a cleaner comprising:

a rotation shaft rotatably supported at a lower surface of a body;

a brush hub fixed to the rotation shaft; and brush hair mounted at an outer circumference surface of the brush hub to sweep dust and contamination of a floor, wherein the brush hair comprises:

a first row divided into a first hair portion which is not contacted with a floor and a second hair portion which is contacted with the floor;

a second row sequentially arranged with the first row, and divided into a first hair portion which is contacted with the floor by facing to the first hair portion of the first row and a second hair portion which is not contacted with the floor by facing to the second hair portion of the first row; and the first hair portion of the second row of the brush hair is located at both sides of the brush hub thus to be contacted with the floor, and the second hair portion of the second row is located at the center of the brush hub and formed to be lower than the first hair portion of the second row.

5. The brush of a cleaner of claim 4, wherein a length of the second hair portion of the second row of the brush hair is longer than that of one first hair portion and shorter than that obtained by adding two first hair portions.

6. The brush of a cleaner of claim 1, wherein the brush hair is mounted toward a shaft direction of the brush hub and has a blade form arranged toward a circumference direction of the brush hair with the same interval.

7. The brush of a cleaner of claim 1, wherein the brush hair has a minute hair form arranged as one row toward a shaft direction of the brush hub.

8. A brush of a robot cleaner having a suction opening at a center of a lower surface of a body for performing a cleaning operation by moving by itself and charging a battery automatically, the brush comprising:

a rotation shaft rotatably supported at the suction opening;

a brush hub fixed to the rotation shaft; and brush hair mounted at an outer circumference surface of the brush hub to sweep dust and contamination of a floor, wherein the brush hair comprises:

a first row divided into a first hair portion which is not contacted with a floor and a second hair portion which is contacted with the floor;

a second row sequentially arranged with the first row and divided into a first hair portion which is contacted with the floor by facing to the first hair portion of the first row and a second hair portion which is not contacted with the floor by facing to the second hair portion of the first row; and the second hair portion of the first row of the brush hair is located at a center of the brush hub thus to be contacted with the floor, and the first hair portion of the first row is located at both sides of the brush hub and formed to be lower than the second hair portion.

9. The brush of a robot cleaner of claim 8, wherein the first row and the second row of the brush hair are mounted toward a shaft direction of the brush hub and sequentially arranged toward a circumference direction of the brush hub.

10. The brush of a robot cleaner of claim 8, wherein a length of the second hair portion of the first row of the brush hair is longer than that of one first hair portion and shorter than that obtained by adding two first hair portions.

11. A brush of a robot cleaner having a suction opening at a center of a lower surface of a body for performing a cleaning operation by moving by itself and charging a battery automatically, the brush comprising:

a rotation shaft rotatably supported at the suction opening;

a brush hub fixed to the rotation shaft; and brush hair mounted at an outer circumference surface of the brush hub to sweep dust and contamination of a floor, wherein the brush hair comprises:

a first row divided into a first hair portion which is not contacted with a floor and a second hair portion which is contacted with the floor;

a second row sequentially arranged with the first row and divided into a first hair portion which is contacted with the floor by facing to the first hair portion of the first row and a second hair portion which is not contacted with the floor by facing to the second hair portion of the first row;

the first hair portion of the second row of the brush hair is located at both sides of the brush hub thus to be contacted with the floor, and the second hair portion of the second row is located at the center of the brush hub and formed to be lower than the first hair portion of the second row.

12. The brush of a robot cleaner of claim 11, wherein a length of the second hair portion of the second row of the brush hair is longer than that of one first hair portion and shorter than that obtained by adding two first hair portions.

13. The brush of a robot cleaner of claim 8, wherein the brush hair is mounted toward a shaft direction of the brush hub and has a blade form arranged toward a circumference direction of the brush hair with the same interval.

14. The brush of a robot cleaner of claim 8, wherein the brush hair has a minute hair form arranged as one row toward a shaft direction of the brush hub.

* * * * *